United States Patent [19]

Oyama et al.

[11] Patent Number: 4,878,147

[45] Date of Patent: Oct. 31, 1989

[54] ELECTROMAGNETIC COIL DRIVE DEVICE

[75] Inventors: Sakan Oyama, Mie; Koji Omori, Kuwana, both of Japan

[73] Assignee: Kabushiki Kaisha Toshiba, Kawasaki, Japan

[21] Appl. No.: 212,674

[22] Filed: Jun. 28, 1988

[30] Foreign Application Priority Data

Aug. 5, 1987 [JP] Japan ..... 62-194443

[51] Int. Cl.[4] ..... H01H 47/04

[52] U.S. Cl. ..... 361/154; 361/187

[58] Field of Search ..... 361/152, 153, 154, 187, 361/168.1, 169.1

[56] References Cited

U.S. PATENT DOCUMENTS

| | | | |
|---|---|---|---|
| 4,071,877 | 1/1978 | Stewart et al. | 361/152 |
| 4,516,185 | 5/1985 | Culligan et al. | 361/154 |
| 4,633,362 | 12/1986 | Saunders | 361/152 |
| 4,636,912 | 1/1987 | Ohtani | 361/154 |
| 4,641,219 | 2/1987 | Aiba | 361/153 |
| 4,649,458 | 3/1987 | Arai et al. | 361/152 |
| 4,679,116 | 7/1987 | Oshizawa et al. | 361/154 |
| 4,812,945 | 3/1989 | D'Onofrio | 361/154 |

FOREIGN PATENT DOCUMENTS

| | | |
|---|---|---|
| 59-181004 | 10/1984 | Japan . |
| 62-145619 | 6/1987 | Japan . |

*Primary Examiner*—A. D. Pellinen
*Assistant Examiner*—H. L. Williams
*Attorney, Agent, or Firm*—Foley & Lardner, Schwartz, Jeffery, Schwaab, Mack, Blumenthal & Evans

[57] ABSTRACT

In an electromagnetic coil drive device an operation coil excites an electromagnet. A switching element is turned on and off by application of a pulse signal thereto and supplies the operation coil with a power supply voltage. A voltage detecting circuit detects the power supply voltage and a gain circuit delivers a closing level signal in accordance with the voltage detected by the voltage detecting circuit. The gain circuit also delivers a holding level signal based on the detected voltage after a predetermined period of time. The level of the holding level signal is higher than that of the closing level signal. A reference wave generating circuit generates a triangular wave. A comparing circuit compares the triangular wave with the closing level signal to thereby generate a closing pulse signal having a predetermined cycle. The comparing circuit also compares the triangular wave with the holding level signal after the predetermined period of time to thereby generate a holding pulse signal having a duty ratio smaller than that of the closing pulse signal. An on-off drive circuit supplies the switching element with the closing and holding pulse signals.

2 Claims, 4 Drawing Sheets

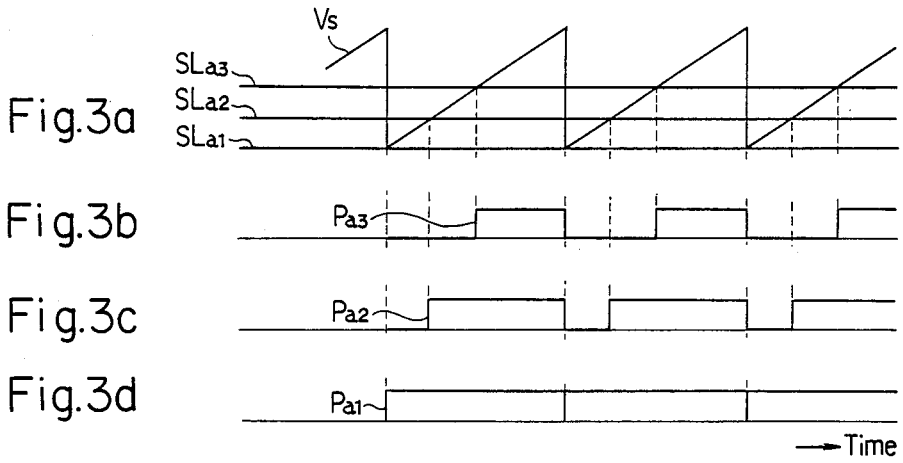
Fig.3a
Fig.3b
Fig.3c
Fig.3d
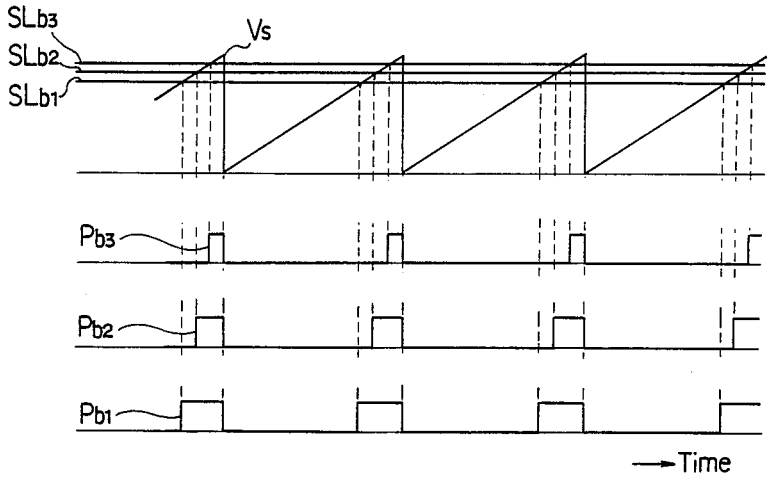
Fig.4a
Fig.4b
Fig.4c
Fig.4d

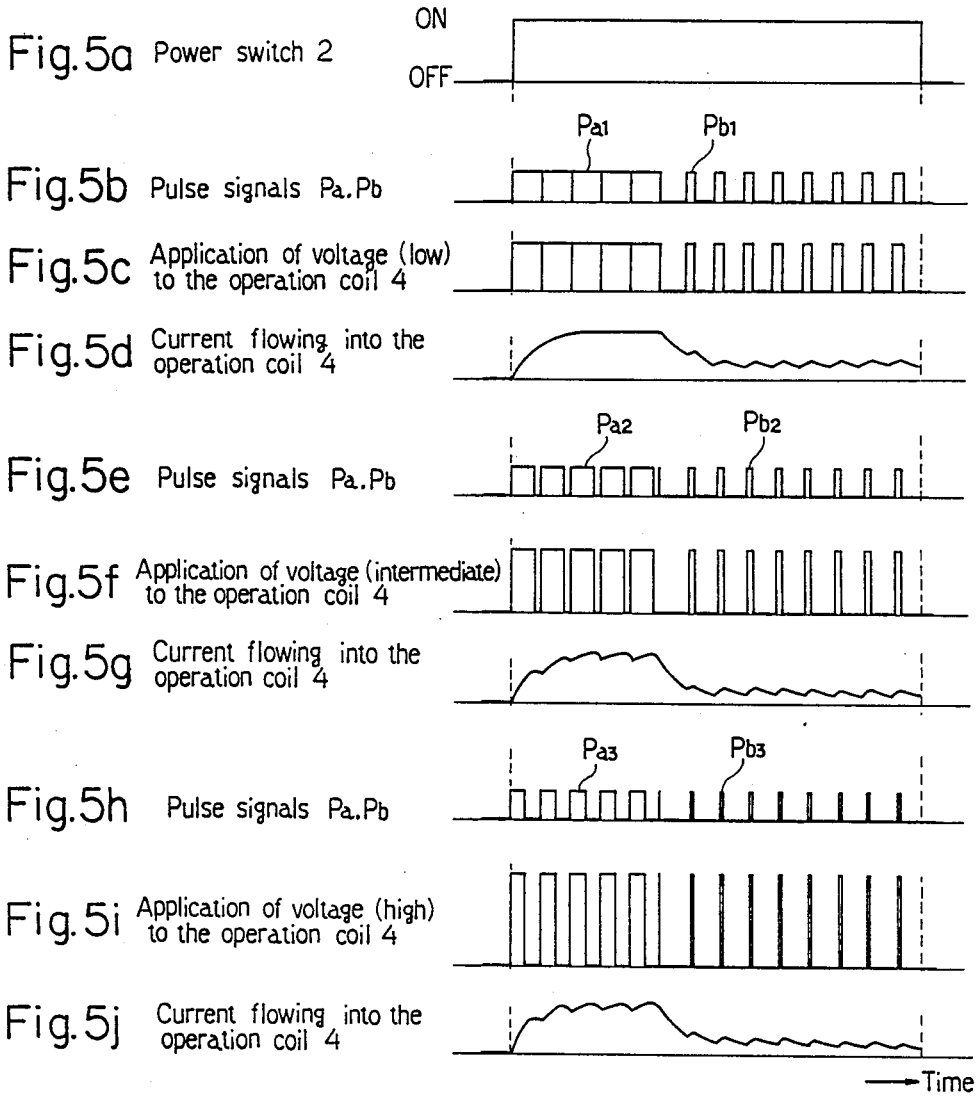
Fig.5a Power switch 2
ON
OFF
Pa1
Pb1
Fig.5b Pulse signals Pa.Pb
Fig.5c Application of voltage (low) to the operation coil 4
Fig.5d Current flowing into the operation coil 4
Pa2
Pb2
Fig.5e Pulse signals Pa.Pb
Fig.5f Application of voltage (intermediate) to the operation coil 4
Fig.5g Current flowing into the operation coil 4
Pa3
Pb3
Fig.5h Pulse signals Pa.Pb
Fig.5i Application of voltage (high) to the operation coil 4
Fig.5j Current flowing into the operation coil 4
Time

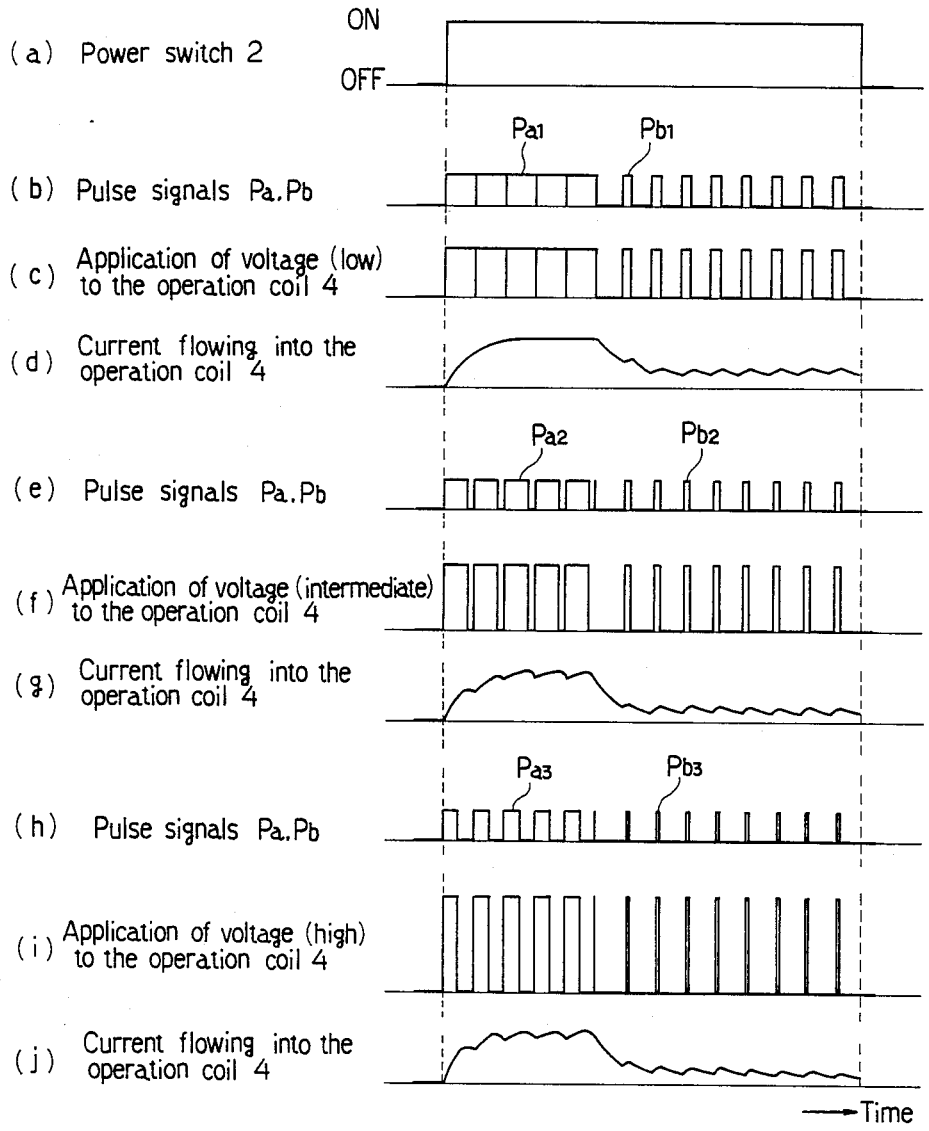
(a) Power switch 2
ON
OFF
Pa1
Pb1
(b) Pulse signals Pa.Pb
(c) Application of voltage (low) to the operation coil 4
(d) Current flowing into the operation coil 4
Pa2
Pb2
(e) Pulse signals Pa.Pb
(f) Application of voltage (intermediate) to the operation coil 4
(g) Current flowing into the operation coil 4
Pa3
Pb3
(h) Pulse signals Pa.Pb
(i) Application of voltage (high) to the operation coil 4
(j) Current flowing into the operation coil 4
Time

ELECTROMAGNETIC COIL DRIVE DEVICE

BACKGROUND OF THE INVENTION

1. Field of the Invention

The present invention relates to an electromagnetic coil drive device incorporating an electronic circuit for generating a pulse signal to intermittently supply a power supply voltage to an operation coil exciting an electromagnetic.

2. Description of the Prior Art

An electromagnetic coil drive device is employed, for example, in electromagnetic switches. It is desirable from the point of electrical power consumption, that when a movable core is to be attracted, a large current flow through an operation coil so that the movable core is attracted and that after attraction of the movable core, a small current flow through the operation coil so that the movable core is held at an attracted position.

In the above-described electromagnetic, when the power supply voltage has different values, for example, 100 V and 200 V, operation coils having different rated voltages are required in accordance with the respective values of the power supply voltage. However, provision of the operation coils having different rated voltages is not desirable from the point of production efficiency.

Japanese Patent Laid-open Application (Kokai) No. 62-145619 discloses an electromagnetic coil drive device in view of the above-described circumstances. The disclosed electromagnetic coil drive device comprises a full-wave rectifying circuit rectifying an AC power supply, a switching element switched by an on-off drive circuit to which a pulse signal is supplied, thereby applying an output voltage (as the power supply voltage) from the rectifying circuit to an operation coil, an integrating circuit integrating the power supply voltage, and a delay circuit starting a time counting operation when the voltage detected by a voltage detecting circuit for detecting the power supply voltage reaches a predetermined level. The electromagnetic coil drive device further comprises a closing oscillation circuit generating a saw-tooth wave, a closing comparing circuit comparing the saw-tooth wave supplied from the closing oscillation circuit with an integrated output from the integrating circuit to thereby generate a closing pulse signal, a holding oscillation circuit generating a saw-tooth wave having a smaller duty ratio than the saw-tooth wave generated by the closing oscillation circuit, a holding comparing circuit comparing the saw-tooth wave generated by the holding oscillation circuit with an integrated output from the integrating circuit to thereby generate a holding pulse signal having a smaller duty ratio than the closing pulse signal generated by the closing comparing circuit, and a switching circuit performing the switching operation so that when the electrical power is supplied, the closing pulse signal generated by the closing comparing circuit is supplied to the on-off drive circuit for switching the switching element and so that after elapse of the predetermined period of time counted by the delay circuit, the holding pulse signal generated by the holding comparing circuit is supplied to the on-off drive circuit, thereby switching the switching element.

The above-described circuit arrangement allows a large current to flow through the operation coil as the closing pulse signal is supplied to the on-off drive circuit when the electrical power is supplied to the operation coil. This circuit arrangement further allows a small current to flow through the operation coil as the holding pulse signal having a smaller duty ratio than the closing pulse signal is supplied to the on-off drive circuit at the time when the movable core is held at the attracted position. Additionally, when the power supply voltage is at a high level, the integrated output from the integrating circuit is also at a high level, both the value of the integrated output of the integrating circuit and the increasing speed thereof are increased to respective values larger than those in the case where the power supply voltage is low. As a result, the duty ratio of the closing pulse signal from the closing comparing circuit is reduced to a value smaller than that in the case where the power supply voltage is low, thereby overcoming the problem of different values of the power supply voltage.

The above-described prior art device, however, necessitates two oscillation circuits for the closing and the holding respectively, two comparing circuits, and a switching circuit switching the oscillation circuits and the comparing circuits. Thus an increased number of electronic parts complicates the circuit arrangement and increases the production cost of the device.

SUMMARY OF THE INVENTION

Therefore, an object of the present invention is to provide an electromagnetic coil drive device wherein a decreased number of electronic parts simplifies the circuit arrangements together with a decrease in the production cost of the device.

The electromagnetic coil drive device in accordance with this invention comprises a switching element for supplying an operation coil of the electromagnetic with a power supply voltage, a voltage detecting circuit detecting the power supply voltage, and a reference wave generating circuit generating a triangular wave or saw-tooth wave. The device is further provided with a gain circuit generating a closing level signal, the level of which is in accordance with the power supply voltage detected by the voltage detecting circuit. The gain circuit further generates a holding level signal, the level of which is higher than that of the closing level signal, based on the closing level signal after elapse of a predetermined period of time. The electromagnetic coil drive device of the present invention is further provided with a comparing circuit comparing the triangular wave or saw-tooth wave from the reference wave generating circuit with the closing level signal from the gain circuit to thereby generate a closing pulse signal in a predetermined cycle. The comparing circuit further compares the triangular wave or saw-tooth wave with the holding level signal to thereby generate a holding pulse signal having a smaller duty ratio than the closing pulse signal. The closing and holding pulse signals, both from the comparing circuit, are supplied to the switching element through an on-off drive circuit. The switching element is switched by the on-off drive circuit to which the closing pulse signal is supplied, and after elapse of the predetermined period of time, by the on-off drive circuit to which the holding pulse signal is then supplied, thereby intermittently supplying the operation coil with the power supply voltage.

According to the electromagnetic coil drive device of this invention, the value of the holding level signal based on the power supply voltage detected by the voltage detecting circuit is rendered higher than that of the closing level signal as the amplification factor of the gain circuit is rendered larger in the holding period than in the closing period. Accordingly, the duty ratio of the holding pulse signal generated by the comparing circuit comparing each of the holding an closing level signals with the triangular wave is rendered smaller than that of the closing pulse signal, whereby the current flowing through the operation coil is rendered small in the holding period than in the closing period. Further, under different values of the rated power supply voltage, the values of the closing and holding level signals are rendered higher in the case where the power supply voltage is at a level higher than in the case where the same is at a low level. Accordingly, the duty ratios of the closing and holding pulse signals are rendered smaller than those in the case of a low power supply voltage. Accordingly, the voltage applied to the operation coil takes predetermined values in accordance with the closing and holding periods, respectively, in spit of the varying of the power supply voltage. Furthermore, the variation of the power supply voltage under the condition of the same rated voltage may also be coped with in the manner described above.

In the electromagnetic coil drive device of this invention, a single reference wave generating circuit and a single comparing circuit are commonly used for generation of the closing and holding pulse signals. In addition, provision of the switching circuit as employed in the prior art device is not necessary in the electromagnetic coil drive device of this invention. Thus, the number of electronic parts may be reduced, thereby simplifying the circuit arrangements and decreasing the production cost.

Other and further objects of the present invention will become obvious upon an understand of the illustrative embodiment above to be described or will be indicated in the appended claim, and various advantages not referred to herein will occur to one skilled in the art upon employment of the invention in practice.

BRIEF DESCRIPTION OF THE DRAWINGS

In the accompanying drawings:

FIGS. 3 through 5 illustrate wave forms of signals for explanation of the operation of the electromagnetic coil drive device in accordance with the present invention.

DESCRIPTION OF THE PREFERRED EMBODIMENT

An embodiment of the electromagnetic coil drive device in accordance with the present invention will now be described with reference to the accompanying drawings.

Figure 1:
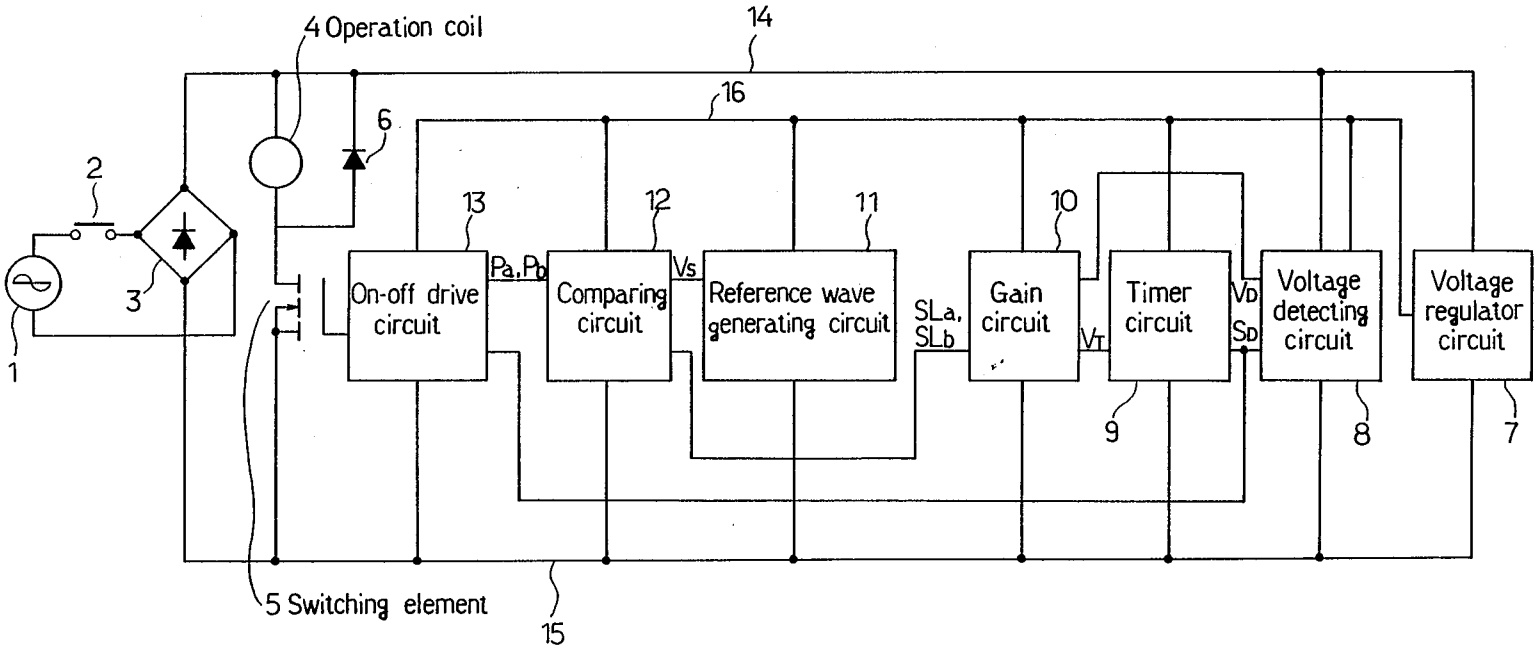
FIG. 1 is a block diagram illustrating a basic electrical arrangement of an embodiment of the electromagnetic coil drive device of this invention.

Referring first to FIG. 1, a basic electrical arrangement of the electromagnetic coil drive device will be described. A full-wave rectifying circuit 3 is supplied, at an AC input terminal thereof, with an AC voltage from an AC power supply 1 when a power switch 2 is closed. The AC power supply 1, power switch 2, and full wave rectifying circuit 3 constitute a main power supply in the embodiment. An operation coil 4 is provided for exciting an electromagnetic employed, for example, in an electromagnetic switch. The operation coil 4 is supplied with the power supply voltage as a DC output voltage of the full-wave rectifying circuit 3 when a field-effect transistor (FET) 5 employed as a switching element is turned on. The operation coil 4 is provided with a flywheel diode 6. A voltage regulator circuit 7 is employed for obtaining a constant DC voltage from the power supply voltage. Both the power supply voltage and the constant DC voltage are supplied to a voltage detecting circuit 8 which generates a detection voltage $V_D$ and a voltage establishment signal $S_D$. The constant DC voltage is also supplied to a timer circuit 9 which is arranged to start a time counting operation when the voltage establishment signal $S_D$ is supplied thereto. The constant DC voltage is further supplied to a gain circuit 10 which amplifies the detection voltage $V_D$ with a predetermined amplification factor, thereby generating a closing level signal SLa for closing a switch. When supplied with a time-up signal $V_T$ from the timer circuit 9, the gain circuit 10 operates to amplify the detection voltage $V_D$ with an amplification factor higher than that employed when the closing level signal SLa is generated, thereby generating a holding level signal SLb for holding the switch at a closing position. The constant DC voltage is further supplied to a reference wave generating circuit 11 which generates a saw-tooth wave $V_S$ as a triangular wave. The constant DC voltage is further supplied to a comparing circuit 12 which compares the saw-tooth wave $V_S$ with the closing level signal SLa to thereby generate a closing pulse signal Pa. Subsequently, the comparing circuit 12 operates to compare the saw-tooth wave $V_S$ with the holding level signal SLb to thereby generate a holding pulse signal Pb. The constant DC voltage is further supplied to an on-off drive circuit 13. When supplied with the voltage establishment signal $S_D$, the on-off drive circuit 13 operates to supply the closing pulse signal Pa to the FET 5, thereby turning the same on and off. Subsequently, the on-off drive circuit 13 supplies the holding pulse signal Pb to the FET 5, thereby turning the same on and off.

Figure 2:
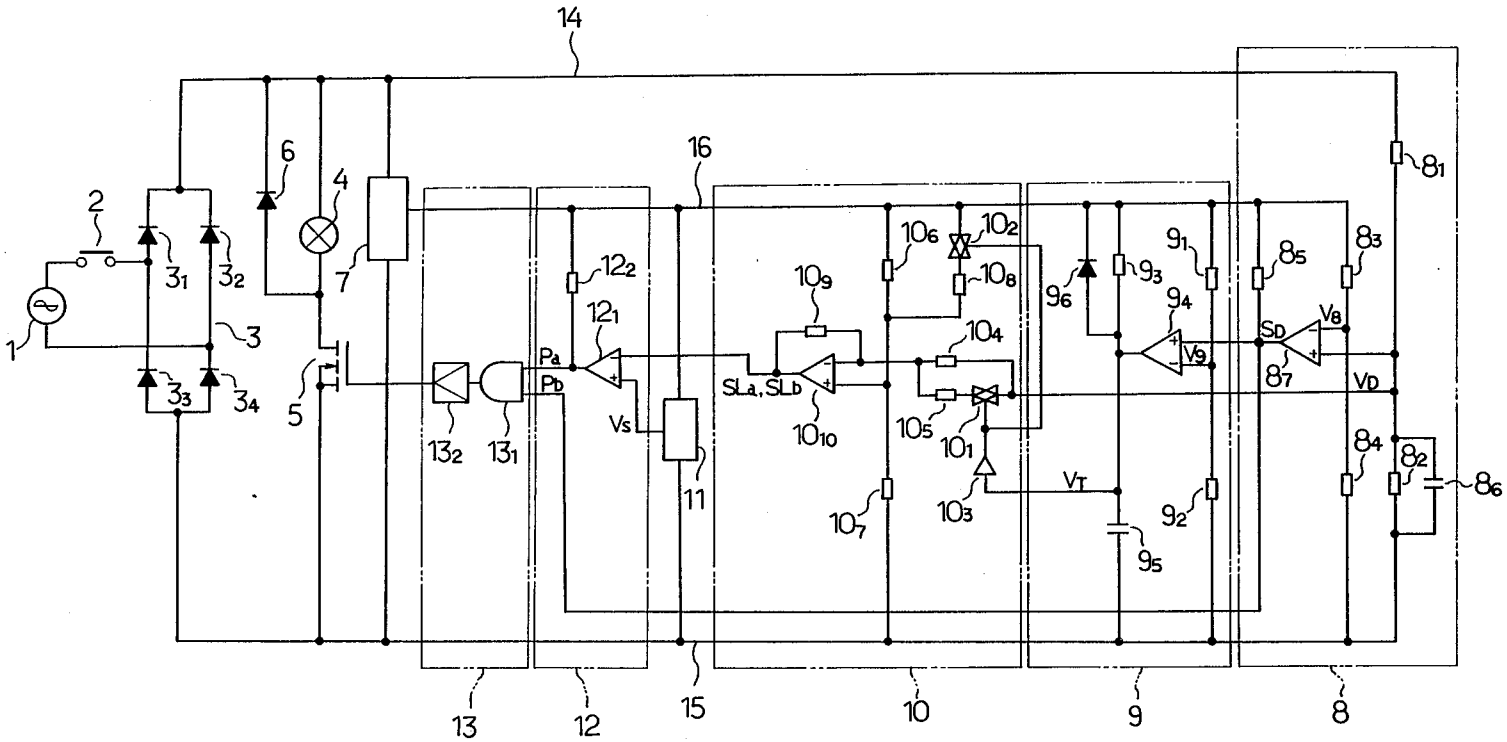
FIG. 2 is a circuit diagram embodying the electrical arrangement of FIG. 1.

Referring now to FIG. 2, a more detailed electrical circuit arrangement is illustrated. The full-wave rectifying circuit 3 comprises diodes $3_1$ to $3_4$ which are bridge-connected. The AC input terminal of the full-wave rectifying circuit 3 is connected to an output terminal of the AC power supply 1 through the power switch 2. DC output terminals of the full-wave rectifying circuit 3 are connected to DC buses 14 and 15, respectively. The FET 5 employed is a common source mode MOS field-effect transistor. A drain of the FET 5 is connected to the DC bus 14 through the operation coil 4 and a source thereof is connected to the DC bus 15. The flywheel diode 6 is connected in parallel with the operation coil 4. The voltage regulator circuit 7 is connected between the DC buses 14 and 15. The output terminal thereof at which the constant DC voltage is delivered is connected to a bus 16. The voltage detecting circuit 8 comprises resistors $8_1$ to $8_5$, a capacitor $8_6$, and a comparator $8_7$ of the open collector type. A series circuit comprising resistors $8_1$ and $8_2$ are connected between the bus-bars 14 and 15. The capacitor $8_6$ is connected in parallel with the resistor $8_2$. A series circuit comprising resistors $8_3$ and $8_4$ is connected between the DC buses 15 and 16. The common connection of the resistors $8_1$ and $8_2$ and the common connection of the resistors $8_3$ and $8_4$ are connected to non-inversible and inversible input terminals (+), (−) of the comparator $8_7$, respectively. An output terminal of the comparator $8_7$ is connected to the DC bus 16 through the resistor $8_5$. The timer circuit 9 comprises resistors $9_1$ to $9_3$, a comparator $9_4$ of the open collector type, a capacitor $9_5$, and a diode $9_6$. A series circuit comprising resistors $9_1$ and $9_2$ is connected between the DC buses 16 and 15. A series circuit comprising the resistor $9_3$ and the capacitor $9_5$ is also connected between the DC buses 15 and 16. The diode $9_6$ is connected in parallel with the resistor $9_3$. The non-inversible input terminal (+) of the comparator $9_4$ is connected to the output terminal of the comparator $8_7$ and the inversible input terminal (−) thereof is connected to the common connection of the resistors $9_1$ and $9_2$. The output terminal of the comparator $9_4$ is connected to the common connection of the resistor $9_3$ and the capacitor $9_5$.

The gain circuit 10 comprises analog switches $10_1$ and $10_2$, a buffer $10_3$ having a Schmidt trigger function, resistors $10_4$ to $10_9$, and an operational amplifier $10_{10}$ for forming a differential amplification circuit. An inversible input terminal (−) of the operational amplifier $10_{10}$ is connected to the common connection of the resistors $8_1$ and $8_2$ through the resistor $10_4$. A series circuit comprising the resistor $10_5$ and analog switch $10_1$ is connected in parallel with the resistor $10_4$. A gate of the analog switch $10_1$ is connected to an output terminal of the buffer $10_3$. An input terminal of the buffer $10_3$ is connected to the common connection of the resistor $9_3$ and capacitor $9_5$. The non-inversible input terminal (+) of the operational amplifier $10_{10}$ is connected to the common connection of the resistors $10_6$ and $10_7$ connected in series to each other between the DC buses 16 and 15. A series circuit comprising the analog switch $10_2$ and the resistor $10_8$ is connected in parallel with the resistor $10_6$. The gate of the analog switch $10_2$ is connected to the output terminal of the buffer $10_3$. The resistor $10_9$ is connected between the inversible input terminal (−) and output terminal of the operational amplifier $10_{10}$. The reference wave generating circuit 11 is connected between the bus 16 and 15 and delivers the saw-tooth wave $V_S$ from the output terminal thereof. The comparing circuit 12 comprises a comparator $12_1$ of the open collector type and a resistor $12_2$. A non-inversible input terminal (+) of the comparator $12_1$ is connected to the output terminal of the reference wave generating circuit 11 and an inversible input terminal (−) thereof is connected to the output terminal of the operational amplifier $10_{10}$. An output terminal of the comparator $12_1$ is connected to the DC bus 16 through the resistor $12_2$. The on-off drive circuit 13 comprises an AND gate $13_1$ and an amplifier $13_2$. One of input terminals of the AND gate $13_1$ is connected to the output terminal of the comparator $8_7$ and the other input terminal thereof is connected to the output terminal of the comparator $12_1$. An output terminal of the AND gate $13_1$ is connected to a gate of the FET 5 through the amplifier $13_2$.

Operation of the electromagnetic coil drive device will now be described with reference to FIGS. 3–5. Upon closure of the power supply switch 2, the AC voltage is supplied to the full-wave rectifying circuit 3 from the AC power supply 1. The full-wave rectifying circuit 3 rectifies the AC voltage to thereby obtain the DC output voltage or power supply voltage, which is supplied to the DC buses 14 and 15. Consequently, the voltage regulator circuit 7 obtains the rated DC voltage from the power supply voltage and supplies the constant DC voltage to the DC buses 16 and 15. The constant DC voltage between the DC buses 16 and 15 is supplied to the voltage detecting circuit 8, timer circuit 9, gain circuit 10, reference wave generating circuit 11, comparing circuit 12, and on-off drive circuit 13. When the power supply voltage between the buses 14 and 15 is supplied to the voltage detecting circuit 8, the power supply voltage is divided by the resistors $8_1$ and $8_2$ and smoothed by the capacitor $8_6$. Accordingly, the detection voltage $V_D$ in proportion to the divided and smoothed power supply voltage is delivered at the common connection of the resistors $8_1$ and $8_2$. The detection voltage $V_D$ is supplied to the non-inversible input terminal (+) of the comparator $8_7$ and the gain circuit 10. A set voltage $V_8$ obtained by dividing the DC voltage between the buses 16 and 15 by the resistors $8_3$ and $8_4$ is supplied to the inversible input terminal (−) of the comparator $8_7$. The set voltage $V_8$ is set so as to be proportional to a predetermined value of the power supply voltage with which the operation coil 4 can be started. Accordingly, when the value of the detection voltage $V_D$ is below that of the set voltage $V_8$ or when the value of the power supply voltage is below the predetermined value, the output signal of the comparator $8_7$ is in a low level (potential level at the bus 15) and accordingly, one of the input signals supplied to the AND gate $13_1$, of the on-off drive circuit 13 is in the low level. As a result, the AND gate $13_1$ is rendered inactive.

When the level of the detection voltage $V_D$ exceeds that of the set voltage $V_8$ or when the level of the power supply voltage exceeds the predetermined level, the comparator $8_7$ delivers a high level signal as the voltage establishment signal $S_D$ from the output terminal thereof. Actually, the level of the voltage establishment signal $S_D$ is the potential of the DC bus 16 through the resistor $8_5$. Since the voltage establishment signal $S_D$ is supplied to one of the input terminals of the AND gate $13_1$, it is rendered active. The voltage establishment signal $S_D$ is also supplied to the non-inversible input terminal (+) of the comparator $9_4$ in the timer circuit 9. The inversible input terminal (−) of the comparator $9_4$ is supplied with the reference voltage $V_9$ obtained by dividing the constant DC voltage between the DC buses 16 and 15 by the resistors $9_1$ and $9_2$. The level of the reference voltage $V_9$ is set so as to be lower than that of the voltage establishment signal $S_D$. Consequently, when the voltage establishment signal $S_D$ is supplied to the non-inversible input terminal (+) of the comparator $9_4$, it delivers a high level output signal from the output terminal thereof. As a result, the capacitor $9_5$ is charged via resistor $9_3$, whereby the timer circuit 9 starts the time counting operation. Since the charging voltage of the capacitor 9 is low when the time counting operation of the timer circuit 9 is just started, the output signal of the buffer $10_3$ is in the low level. Accordingly, the analog switches $10_1$ and $10_2$ are in the nonconducting state. Since the detection voltage $V_D$ is also supplied to the gain circuit 10 as described above, the detection voltage $V_D$ is amplified with an amplification factor depending on the resistors $10_4$, $10_9$ and the voltage depending on the resistors $10_6$, $10_7$ and delivered as a closing level signal SLa. The closing level signal SLa is supplied to the inversible input terminal (−) of the comparator $12_1$ of the comparing circuit 12. The non-inversible input terminal (+) of the comparator $12_1$ is supplied with the saw-tooth wave $V_S$ from the reference wave generating circuit 11. The saw-tooth wave $V_S$ has a predetermined cycle as shown in FIG. 3 (a) and FIG. 4 (a). Accordingly, the comparator $12_1$ delivers a high level closing pulse signal Pa in the period in which the level of the saw-tooth wave $V_S$ is higher than that of the closing level signal SLa. The closing pulse signal Pa is supplied to the active AND gate $13_1$ of the on-off drive circuit 13 and the gate of the FET 5 through the amplifier $13_2$. The FET 5 is turned on and off in accordance with the closing pulse signal Pa, thereby intermittently supplying the operation coil 4 with the power supply voltage, whereby the operation coil 4 excites an electromagnetic (not shown). The movable core (not shown) is attracted by the electromagnetic, thereby executing the closing operation.

Subsequently, when the timer circuit 9 completes the counting of a period of time set, the charging voltage of the capacitor $9_5$ reaches a predetermined level. The charging voltage is supplied as a time-up signal $V_T$ to the buffer $10_3$. The period of time set at the timer circuit 9 is determined to be enough for the electromagnetic to attract the movable core and complete the closing operation. The output signal is turned to the high level when the time-up signal $V_T$ is supplied to the buffer $10_3$, thereby causing the analog switches $10_1$ and $10_2$ to be conductive. Accordingly, the resistors $10_5$ and $10_8$ are inserted so as to form parallel circuits with the resistors $10_4$ and $10_6$, respectively. In this case, the detection voltage $V_D$ is amplified with the amplification factor depending on the resistors $10_4$, $10_5$ and $10_9$ and the voltage depending on the resistors $10_6$, $10_8$ and $10_7$. The detection voltage $V_D$ thus amplified is delivered as a holding level signal SLb. The gain circuit 10 is designed so that the value of the holding level signal STb is rendered larger than that of closing level signal SLa. The holding level signal SLb is supplied to the comparing circuit 12, as in the case of the closing level signal SLa. The holding pulse signal Pb having a duty ratio SLa. As a result, the holding pulse signal Pb having a duty ratio smaller than that of the closing pulse signal Pa is delivered from the comparator $12_1$ and supplied to the gate of the FET 5 through the on-off drive circuit 13. The FET 5 is turned on and off in accordance with the holding pulse signal Pb supplied thereto, thereby intermittently supplying the power supply voltage to the operation coil 4. Thus, the movable core is attracted by the electromagnetic and held at the attracted position.

The following is a description of the case where the AC voltage of the AC power supply 1 takes different values such as a low voltage (100 V, for example), a high voltage (200 V), and an intermediate voltage (an intermediate value between the high and low voltages). As the values of the AC voltage of the AC power supply 1 differ from one another, the levels of the power supply voltage supplied to the DC buses 14 and 15 also differ from one another, as the low, intermediate, and high voltages and the levels of the detection voltage $V_D$ further differ from one another. Accordingly, the level of the closing level signal SLa delivered from the gain circuit 10 is varied from $SLa_1$ (corresponding to the low voltage) to $SLa_2$ (corresponding to the intermediate voltage) and $SLa_3$ (corresponding to the high voltage), as shown in FIG. 3 (a). Further, the duty ratio of the closing pulse signal Pa delivered from the comparing circuit 12 is varied from $Pa_1$ (corresponding to the low voltage) to $Pa_2$ (corresponding to the intermediate voltage) and $Pa_3$ (corresponding to the high voltage), as shown in FIGS. 3 (*d*), (*c*) and (*b*) and FIG. 5 (*b*), (*e*) and (*h*). That is, the duty ratio of the closing pulse signal Pa is reduced in turn as $Pa_1$, $Pa_2$ and $Pa_3$ as the power supply voltage is raised. When the respective closing pulse signals $Pa_1$, $Pa_2$ and $Pa_3$ are supplied to the FET 5 through the on-off drive circuit 13, the FET 5 is turned on and off in accordance with the respective closing pulse signals. Accordingly, the power supply voltage is applied to the operation coil 4 as shown in FIGS. 5 (*c*), (*f*) and (*i*) and the average applied voltage takes an approximately fixed value. Consequently, an amount of current flowing into the operation coil 4 takes an approximately fixed value, as shown in FIGS. 5 (*d*), (*g*) and (*j*) and the movable core is then attracted by the electromagnetic, thereby executing the closing operation.

Subsequently, when the timer circuit 9 completes the time counting operation, the amplification factor of the gain circuit 10 is varied. The level of the holding level signal SLb is varied from $SLb_1$ (corresponding to the low voltage) to $SLb_2$ (corresponding to the intermediate voltage) and $SLb_3$ (corresponding to the high voltage), as shown in FIG. 4 (*a*). The duty ratio of the holding pulse signal Pb delivered from the comparing circuit 12 is varied from $Pb_1$ (corresponding to the low voltage) to $Pb_2$ (corresponding to the intermediate voltage) and $Pb_3$ (corresponding to the high voltage), as shown in FIGS. 4 (*d*), (*c*) and (*b*) and FIGS. 5 (*b*), (*e*) and (*h*). This is, the duty ratio of the holding pulse signal Pb is reduced as shown by $Pb_1$, and $Pb_2$ and $Pb_3$ as the power supply voltage is raised. The holding pulse signals $Pb_1$, $Pb_2$ and $Pb_3$ are supplied to the FET 5 through the on-off drive circuit 13. The FET 5 is turned on and off in accordance with the holding pulse signals $Pb_1$, $Pb_2$ and $Pb_3$. Accordingly, the power supply voltage is applied to the operation coil 4 as shown in FIGS. 5 (*c*), (*f*) and (*i*) and the average applied voltage takes an approximately fixed value which is smaller than that of the average applied voltage in the case of the switch closing operation. An amount of current flowing into the operation coil 4 takes an approximately fixed value, as shown in FIGS. 5 (*d*), (*g*) and (*j*). The movable core is then held by the electromagnetic.

Although the FET 5 is employed as a switching element in the foregoing embodiment, a bipolar transistor or other elements may be employed. Furthermore, although the differential amplification circuit is employed as the gain circuit 10 in the previous embodiment, an operational amplification circuit may be employed instead. In the operational amplification circuit, a non-inversible input terminal (+) of the operational amplifier $10_{10}$ is directly connected to the DC bus 15 and accordingly, the resistors $10_6$, $10_7$ and $10_8$ and the analog switch $10_2$ may not be necessary.

Additionally, the electromagnetic coil drive device of the present invention may be applied not only to electromagnetic switches but also to other equipment in which an electromagnet is employed.

The foregoing disclosure and drawings are merely illustrative of the principles of the present invention and are not to be interpreted in a limiting sense. The only limitation is to be determined from the scope of the appended claim.

What is claimed is:

1. An electromagnetic drive device comprising:

(a) a bus connected to a main power supply;

(b) a constant voltage supply producing a constant reference voltage;

(c) a switch connected in series with an operation coil;

(d) a voltage detecting circuit, connected to the bus, detecting a main power supply voltage and supplying a detection voltage in accordance with the main power supply voltage;

(e) a timer producing an output signal after elapse of a time period set in the timer;

(f) a gain circuit producing a first signal which corresponds to a difference between the reference voltage and the detection voltage;

(g) a control circuit controlling the gain circuit such that closing level signal is produced from the gain circuit before elapse of the time period set in the timer and such that a holding level signal is produced from the gain circuit after elapse of the time period set in the timer;

(h) a reference wave generating circuit generating a reference wave;

(i) a comparing circuit comparing the reference wave with the closing and holding level signals, the comparing circuit generating closing pulse signals having a first predetermined period and holding pulse signals having a second predetermined period; and (j) a drive circuit which controls the switch in response to the closing pulse signal and the holding pulse signal.

2. A drive device energizing an operation coil which excites an electromagnetic, the drive device comprising:

(a) a main power supply including a power switch;

(b) a bus connected to the main power supply so that a first voltage is applied to the bus from the main power supply when the power switch is closed;

(c) a constant voltage supply producing a constant second voltage in spite of voltage variation on the bus;

(d) a switching element connected to the bus in series with the operation coil such that the first voltage can be supplied to the operation coil;

(e) a voltage detecting circuit, connected to the bus, detecting the first voltage and supplying a detection voltage in accordance with the first voltage;

(f) a timer adapted to start a time counting operation in response to a voltage establishment on the bus, the timer producing a first output signal after elapse of a time period set in the timer;

(g) a gain circuit having first and second input terminals and producing a second output signal, a level of the second output signal corresponding to a difference between a voltage supplied to the first and second input terminals, the first input terminal being supplied with the second voltage, the second input terminal being supplied with the detection voltage;

(h) mode change means for changing a value of voltages supplied to the first and second input terminals in response to the first output signal such that a closing level signal is produced from the gain circuit before elapse of the time period set in the timer and such that a holding level signal, a level of which is greater than the level of the closing level signal, is produced from the gain circuit after elapse of the time period set in the timer;

(i) a reference wave generating circuit generating a triangular wave;

(j) a comparing circuit comparing the triangular wave with the closing and holding level signals and generating closing pulse signals having a predetermined period with respect to the closing level signal and holding pulse signals, having a duty ratio smaller than the duty ratio of the closing pulse signals, with respect to the holding level signal; and (k) on-off control means for on-off controlling the switching element in response to the closing and holding pulse signals such that the switching element is activated in accordance with duty ratios of respective closing and holding pulse signals.

* * * * *